US005721526A

United States Patent [19]

Daimon et al.

[11] Patent Number: 5,721,526

[45] Date of Patent: Feb. 24, 1998

[54] COMPACT HIGH-VOLTAGE VARIABLE RESISTOR

[75] Inventors: Kazufumi Daimon, Namerikawa; Tsuyoshi Ohta, Toyama; Kenichi Hiraki, Inami-machi, all of Japan

[73] Assignee: Hokuriku Electric Industry Co., Ltd., Kami-Niikawagun, Japan

[21] Appl. No.: 683,706

[22] Filed: Jul. 18, 1996

[30] Foreign Application Priority Data

Jul. 20, 1995 [JP] Japan ..... 7-184328
Jul. 20, 1995 [JP] Japan ..... 7-184329

[51] Int. Cl.[6] ..... H01C 10/30

[52] U.S. Cl. ..... 338/160

[58] Field of Search ..... 338/160, 162, 338/70, 219, 163, 174, 175, 176

[56] References Cited

U.S. PATENT DOCUMENTS

| | | | |
|---|---|---|---|
| 2,454,816 | 11/1948 | Levy . | |
| 3,512,113 | 5/1970 | Kirkendall . | |
| 3,601,743 | 8/1971 | Mathison et al. . | |
| 3,639,878 | 2/1972 | Scheel . | |
| 3,696,318 | 10/1972 | Mack . | |
| 3,772,630 | 11/1973 | Falco | 338/174 |
| 4,344,063 | 8/1982 | Nishimoto et al. | 338/160 |
| 4,635,028 | 1/1987 | Oelsch et al. | 338/171 |
| 4,679,025 | 7/1987 | Ohashi | 338/197 |
| 4,835,511 | 5/1989 | Henmi | 338/174 |
| 4,884,052 | 11/1989 | Eitoku et al. | 338/202 |
| 5,500,634 | 3/1996 | Ueda | 338/174 |
| 5,508,678 | 4/1996 | Tsunezawa et al. | 338/160 |

*Primary Examiner*—Edward Tso
*Attorney, Agent, or Firm*—Pearne, Gordon, McCoy & Granger LLP

[57] ABSTRACT

A high-voltage variable resistor capable of significantly reducing a circuit board as compared with a prior art. Terminal fitments each are arranged so as to function as a connector for forming electrical connection between a slide element slid on each of variable resistance patterns and a terminal acting as an output section. A contact point between a contact on a contact support of the terminal fitment and a plate-like member of the slide element is positioned apart from a surface of the circuit board. The terminal fitment includes a positioner, which is positioned outside the pattern in a radial direction thereof, so that the positioner intersects the pattern while being spaced therefrom.

17 Claims, 4 Drawing Sheets

COMPACT HIGH-VOLTAGE VARIABLE RESISTOR

BACKGROUND OF THE INVENTION

This invention relates to a high-voltage variable resistor, and more particularly to a high-voltage variable resistor decreased in size.

A conventional high-voltage variable resistor which has been commonly known in the art is generally constructed in such a manner as shown in FIG. 5. The conventional high-voltage variable resistor is called a focus pack adapted to variably output a focus voltage and a screen voltage and includes a circuit board generally designated at reference numeral 101 by way of example in FIG. 5. The circuit board 101 is formed-on a front surface thereof with a circuit pattern 102 by printing, which includes an input electrode E1, a focus voltage output electrode E2, a screen voltage output electrode E3 and a ground electrode E4, as well as a first variable resistance pattern VR1 for focus voltage variation and a second variable resistance pattern VR2 for screen voltage variation. The circuit pattern 102 includes connection patterns CP1 and CP2 each acting as a connection means which is contacted with a slide element (not shown) to electrically connect the slide element to each of the output electrodes E1 and E2. The slide element includes a slide contact sliding on the variable resistance patterns VR1 and VR2 and pivotally moved on ends CP11 and CP12 of the connection patterns CP1 and CP2.

A size of the high-voltage variable resistor is generally determined depending on an area of the circuit board 101, which is determined depending on the circuit pattern 102. In determination of the circuit pattern 102, a distance between sections of the circuit pattern 102 adjacent to each other is determined in view of so-called pattern dielectric strength (normally, 1 mm/kV) which prevents arcing or discharge. Thus, a distance A between the variable resistance pattern VR1 and an end CP11 of the connection pattern CP1 and a distance B between the variable resistance pattern VR2 and an end CP21 of the connection pattern CP2 are likewise regulated by the pattern dielectric strength. This results in an increase in radius of an arc defined by each of the variable resistance patterns VR1 and VR2 being required depending on a magnitude or level of a voltage applied thereto, so that a decrease in area of the circuit board is subject to restriction.

SUMMARY OF THE INVENTION

The present invention has been made in view of the foregoing disadvantage of the prior art.

Accordingly, it is an object of the present invention to provide a high-voltage variable resistor which is capable of permitting a circuit board to be reduced in size as compared with the prior art.

It is another object of the present invention to provide a high-voltage variable resistor which is capable of being reduced in size as compared with the prior art.

It is a further object of the present invention to provide a high-voltage variable resistor which is capable of reducing abrasion between a slide element and a contact of a connection means.

It is still another object of the present invention to provide a high-voltage variable resistor which is capable of preventing effective deformation of a slide element and a connection means.

It is yet another object of the present invention to provide a high-voltage variable resistor which is capable of facilitating positioning and mounting of a slide element.

It is a still further object of the present invention to provide a high-voltage variable resistor which is capable of reducing a size of a circuit board while substantially preventing occurrence of discharge.

In accordance with the present invention, a high-voltage variable resistor is provided. The high-voltage variable resistor generally includes a circuit board provided on a front surface thereof with at least one variable resistance pattern, at least one operation shaft arranged so as to be spaced from the front surface of the circuit board, at least one slide element mounted on the operation shaft and including a slide contact sliding on the variable resistance pattern, and at least one connection means including an output section and contacted with a part of the slide element to electrically connect the slide element and output section to each other.

In the conventional high-voltage variable resistor described above, the connection pattern is formed on the front surface of the circuit board so as to act as a connection means and connected at an end thereof to a part of the slide element. This causes a connection point between the connection means and the slide element to be positioned on the front surface of the circuit board. On the contrary, in the present invention, the connection means and slide element are so arranged that a contact point between the connection means and the slide element is spaced from the front surface of the circuit board on a side of the operation shaft, resulting in being positioned apart from the front surface of the circuit board. From a viewpoint of a design, this means that the connection means and slide element are so arranged that a contact point between the connection means and the slide element is spaced from the front surface of the circuit board on a side of the operation shaft and a maximum potential difference between the connection means and slide element and the variable resistance pattern is rendered smaller than a discharge occurrence potential difference. Such construction of the present invention keeps the contact point from being positioned at a central portion of the variable resistance pattern, so that a radius of curvature of the variable resistance pattern may be reduced to a level sufficient to prevent discharge between ends of the variable resistance patterns. This results in a circuit pattern formed on the front surface of the circuit board being reduced in size, leading to a reduction in size of the circuit board, to thereby contribute to down-sizing of the high-voltage variable resistor.

Construction and mounting of the connection means may be carried out in any desired manner. The circuit board may be generally received in an insulating casing. The connection means includes a contact contacted with the slide element, a contact support for supporting the contact thereon and a positioner for positioning the contact support with respect to at least one of the circuit board and insulating casing. The connection means is arranged so that the contact support intersects the variable resistance pattern while being spaced from the variable resistance pattern. The contact support preferably exhibits elasticity sufficient to force the contact toward the slide element. The positioner may be constructed in any manner. For example, the insulating casing may be provided with a fit portion, in which the positioner is fitted, to thereby position the connection means. Alternatively, positioning of the connection means may be carried out by interposedly arranging the positioner between the insulating casing and the circuit board or mounting the positioner on electrodes on a circuit pattern formed on the front surface of the circuit board by soldering. Also, the positioning may be accomplished by providing the positioner with a support mechanism or clip mechanism for interposedly supporting an end of the circuit board or a supported element formed on an inner surface of the insulating casing. The positioning may be carried out by loosely or tightly fitting the positioner in any through-hole or groove.

The positioner thus acting to fixedly position the connection means may be integrally provided with an output section for the high-voltage variable resistor. The output section may be constructed in any manner. For example, it may be in the form of a terminal to which a lead wire is connected by soldering or formed into a connection structure for securely holding a lead wire or a pin-like terminal inserted thereinto. Alternatively, it may be constructed into a connection structure of the snap-in type provided with a holding element which is adapted to eat into a pin-like terminal inserted thereinto when the terminal is pulled. Such integral arrangement of the output section on the positioner reduces the number of parts, as well as the number of steps for manufacturing of the resistor. Alternatively, the connection means and output section may be formed separately from each other and then connected to each other using any suitable connection means.

In particular, in the present invention, the connection means is arranged so that the contact support intersects the variable resistance pattern while being spaced from the variable resistance pattern. More specifically, the connection means is arranged so that the positioner is positioned outside the variable resistance pattern in a radial direction thereof and the contact support intersects the variable resistance pattern while being spaced from the variable resistance pattern. An interval between the contact support and the variable resistance pattern is defined so as to prevent discharge therebetween. Such arrangement significantly reduces a space for arrangement of the variable resistance section on the circuit board. A distance to be provided between the positioner of the connection means and a center of an arc defined by the variable resistance pattern may be represented at L and a radius of the variable resistance pattern may be represented at r. When the positioner of the connection means is located inside the variable resistance pattern in a radial direction of the pattern, a length of the longest portion of the space for the arrangement of the variable resistance section is L+r or more. On the contrary, the present invention permits the length to be L at the lowest, resulting in significantly reducing the space on the circuit board, leading to further down-sizing of the circuit board. When a plurality of variable resistance patterns are arranged on the circuit board, the present invention may be applied to at least one of the patterns. The positioners of the connection means corresponding to the remaining variable resistance sections or patterns each may be arranged inside the pattern in the radial direction thereof.

The slide element may include an arm provided with a slide contact slid on a surface of the variable resistance pattern and a plate-like member supported on an end of the operation shaft opposite to the circuit board. In this instance, the end of the operation shaft is provided with a spacer which is arranged so as to be coaxial with the operation shaft and project therefrom toward the circuit board. The connection means is arranged so that the contact slides on a surface of the plate-like member of the slide element while describing a locus about an axis of the operation shaft.

In order to provide the arm with elasticity, it is required to increase a length of the arm to a certain degree. In view of the requirement, the plate-like member of the slide element includes a slide portion on which the contact of the connection means slides, a through-hole portion formed with a through-hole via which the spacer is inserted and a mount portion opposite to the slide portion with the through-hole being interposed between the mount portion and the slide portion. Also, the arm has a fixed end fixed on the mount portion and a free end extending toward the slide portion and is formed with a slit through which the spacer is movably inserted.

Also, in accordance with the present invention, a high-voltage variable resistor is provided. The high-voltage variable resistor generally includes a circuit board provided on a front surface thereof with a plurality of variable resistance patterns of an arcuate shape, a plurality of operation shafts arranged so as to be spaced from the front surface of the circuit board and respectively correspond to the variable resistance patterns, a plurality of slide elements respectively mounted on the operation shafts and each including a slide contact sliding on the variable resistance pattern corresponding thereto, and a plurality of connection means arranged so as to respectively correspond to the variable resistance patterns and each including an output section and contacted with a part of each of the slide elements to electrically connect the slide element and output section to each other. The variable resistance patterns are arranged on the front surface of the circuit board so that centers of arcs respectively defined by the variable resistance patterns of an arcuate shape are aligned with each other in a longitudinal direction of the circuit board. This permits a width of the circuit board to be reduced. In particular, the variable resistance patterns may be formed on the front surface of the circuit board so that axes of the variable resistance patterns of an arcuate shape are aligned with each other on a virtual straight line extending in said longitudinal direction of the circuit board. This leads to a further decrease in width of the circuit board.

In order to further reduce a width of the circuit board, the connection means each may be so arranged that an angle θ between the virtual straight line and a shade of the contact support of the connection means obtained when the connection support is projected on the circuit board is less than 90 degrees. A decrease in angle θ to a level of 45 degrees or less permits a width of the circuit board to be further reduced.

Such down-sizing of the circuit board has a possibility of often causing discharge to occur between the connection means. In order to avoid such a problem, the connection means are so arranged that the positioners of two such connection means provided in correspondence to two such variable resistance patterns adjacent to each other are arranged on different two of sides of the circuit board.

Further, in the present invention, the two variable resistance patterns may be arranged on the front surface of the circuit board so that openings of the two variable resistance patterns of an arcuate shape are rendered opposite to each other while being kept facing inwardly. This permits a size of the variable resistance patterns to be decreased because no electrode is arranged inside each of the variable resistance patterns.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a high-voltage variable resistor according to the present invention will be described hereinafter with reference to FIGS. 1A to 4C.

Figure 1A:
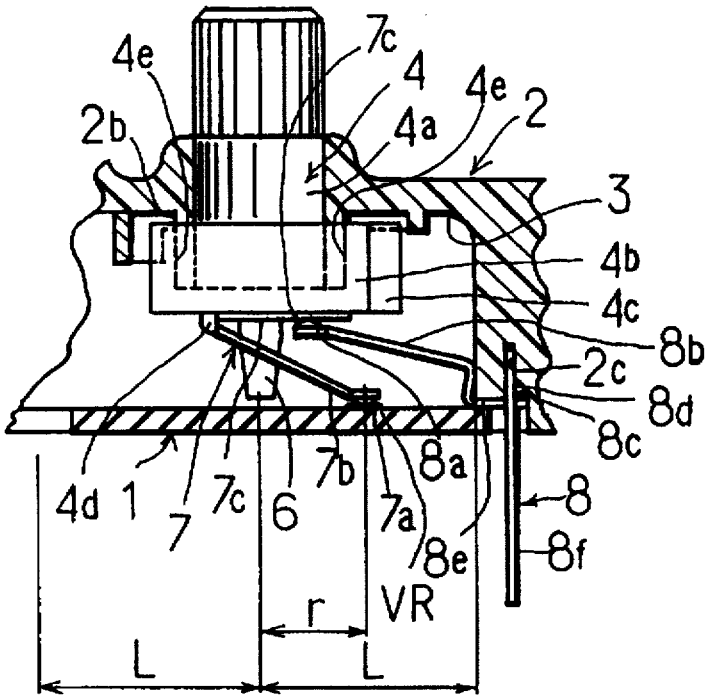
FIG. 1A is a fragmentary schematic sectional view showing an essential part of a high-voltage variable resistor according to the present invention.
Figure 1B:
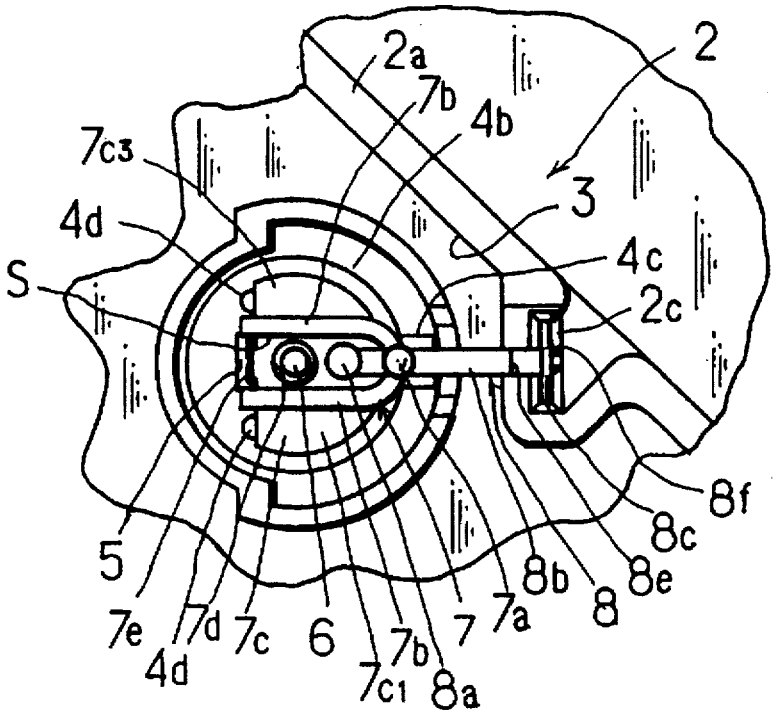
FIG. 1B is a fragmentary bottom view of the high-voltage variable resistor shown in FIG. 1A wherein a circuit board is removed for the sake of brevity.

Referring first to FIGS. 1A and 1B, an embodiment of a high-voltage variable resistor according to the present invention is illustrated. A high-voltage variable resistor of the illustrated embodiment includes a circuit board 1 made of a ceramic material and provided on a front surface thereof with at least a variable resistor pattern and an insulating casing 2 formed therein with a storage or receiving chamber 3 in which the circuit board 1, a slide element described hereinafter and the like are received. The insulating casing 2 is made of an insulating resin material and open at one end thereof. The circuit board 1 is joined to a rib 2*a* formed on a periphery of the receiving chamber 3 of the insulating casing 2 by means of an adhesive.

Figure 2A:
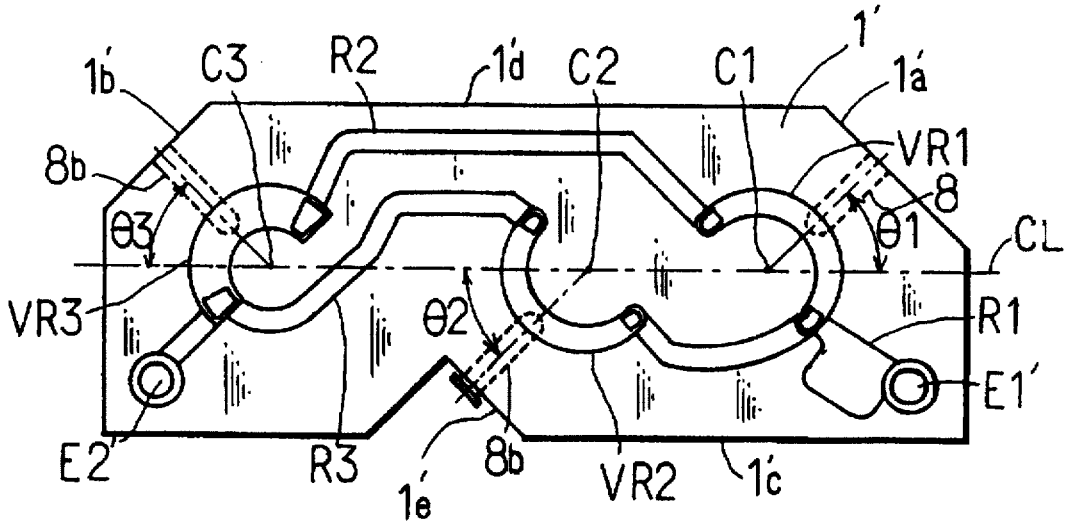
FIG. 2A is a plan view showing an example of a circuit board incorporated in a high-voltage variable resistor of the present invention.
Figure 2B:
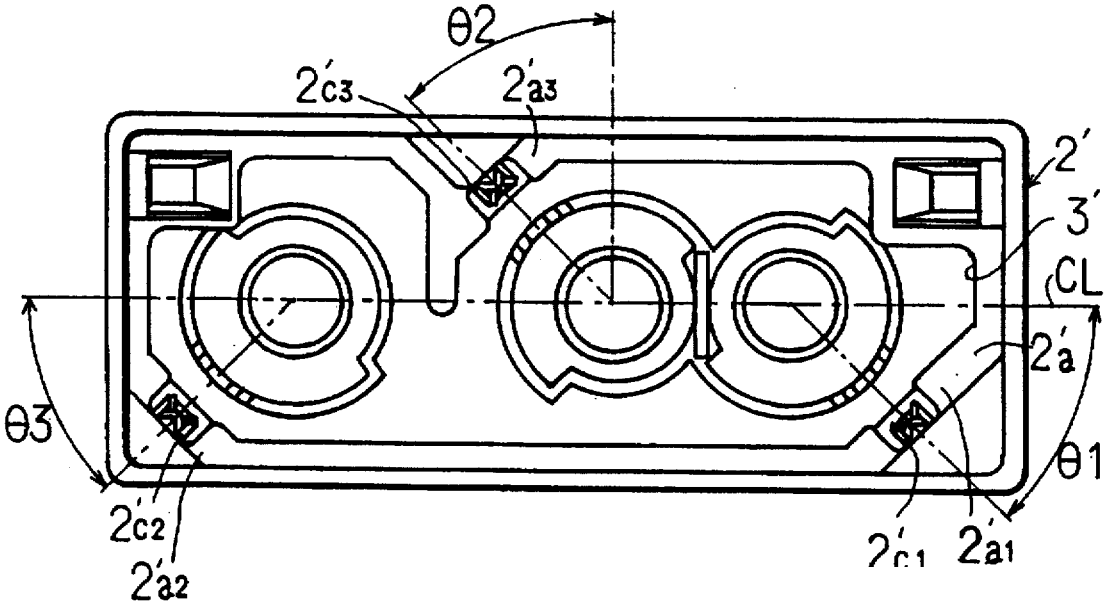
FIG. 2B is a bottom view showing an insulating casing in which the circuit board shown in FIG. 2A is received.

The circuit board 1 is formed on the front surface thereof with a circuit pattern like a circuit pattern formed on a front surface of a circuit board 1' shown in FIG. 2A. An insulating casing 2' in which the circuit board 1' of FIG. 2A is received is constructed as shown in FIG. 2B. The insulating casing 2' of FIG. 2B is designed to receive the circuit board 1' of FIG. 2A therein, resulting in being not the same as the insulating casing 2 of FIG. 1A. The circuit pattern shown in FIG. 2A includes an input electrode E1', a ground electrode E2', first and second variable resistance patterns VR1 and VR2 for double focus voltage variation, a third variable resistance pattern VR3 for screen voltage variation, and fixed resistance sections R1 to R3. The circuit pattern of FIG. 2A and the insulating casing 2' of FIG. 2B will be described hereinafter.

Figure 3A:
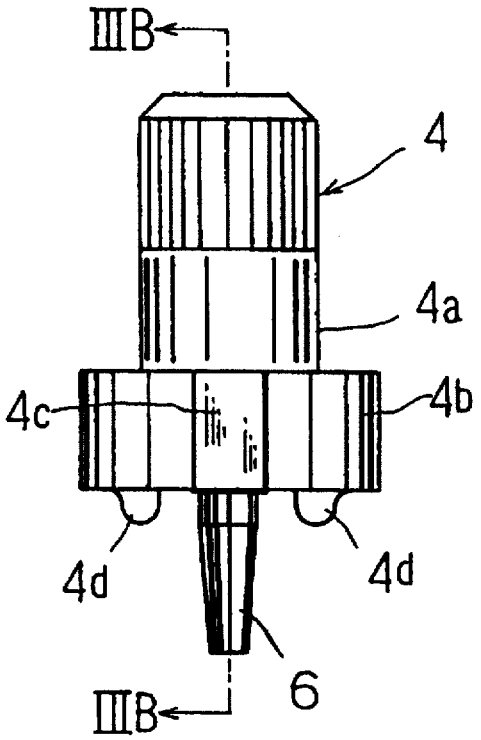
FIG. 3A is a front elevation view showing an operation shaft incorporated in the high-voltage variable resistor shown in FIG. 1A.
Figure 3B:
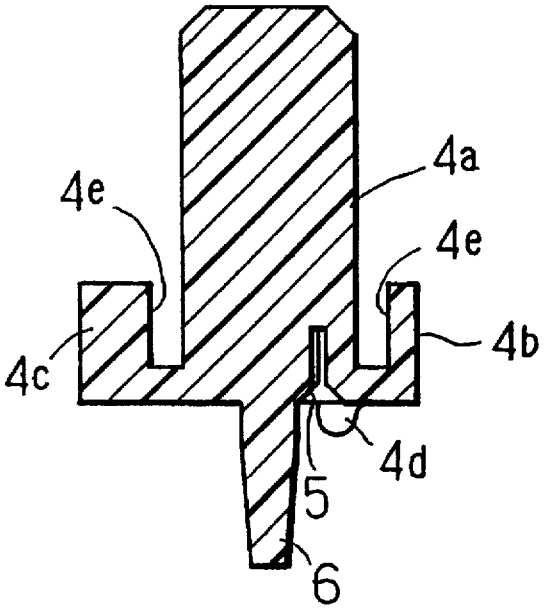
FIG. 3B is a sectional view taken along line IIIB—IIIB of FIG. 3A.
Figure 3C:
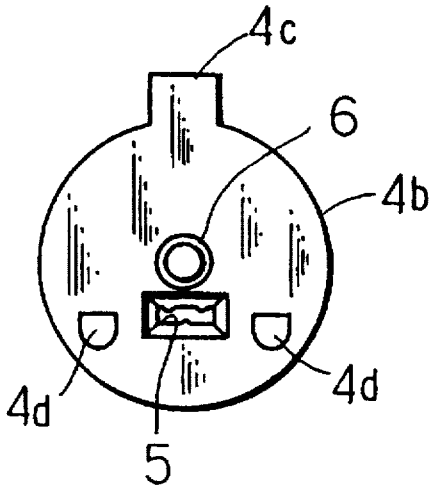
FIG. 3C is a bottom view of the operation shaft shown in FIG. 3A.

Referring to FIGS. 1A and 1B again, reference numeral 4 designates at least one operation shaft including a shaft member 4*a* arranged so as to extend through an upper wall of the insulating casing 2 into the casing 2, and a slide-element positioner 4*b* and a stopper 4*c* of a large diameter each formed integrally with the shaft member 4*a* and positioned in the receiving chamber 3. The operation shaft 4 is integrally formed of an insulating resin material and constructed as shown in FIGS. 3A to 3C. The slide element positioner 4*b* of the operation shaft 4 is formed on an end surface thereof facing the circuit board 1 with a substantially vertically extending hole 5 and a spacer 6. The spacer 6 is arranged so as to be coaxial with the operation shaft 4. More particularly, the spacer 6 is arranged so as to be projected toward the circuit board 1 along a center of the operation shaft 4. The spacer 6 thus arranged functions to regulate movement of the operation shaft 4 toward the circuit board 1 to prevent excessive compression of a slide element 7 described hereinafter during operation of the operation shaft 4. The vertically extending hole 5 has a raised element 7*e* (FIGS. 4A to 4C) of the slide element 7 fitted therein, to thereby prevent rotation of the slide element 7. In the illustrated embodiment, the vertically extending hole 5, spacer 6 and stopper 4*c* are arranged in a row in a diametric direction of the operations haft 4. Also, the slide element positioner 4*b* of the operations haft 4 is integrally formed on an end thereof with two projections 4*d* for engagement. The projections 4*d* are arranged so as to interpose the vertically extending hole 5 therebetween.

The slide element positioner 4*b* of the operation shaft is provided with a recess, in which the shaft member 4*a* of the operation shaft 4 is received to define an annular fit groove 4*e* therearound. The fit groove 4*e* is fitted therein with a cylindrical portion 2*b* provided on an inner surface of the insulating casing 2 so as to inwardly extend therefrom. The cylindrical portion 2*b* is loosely fitted in the groove 4*e* so that the operation shaft 4 may be rotated in the recess.

Figure 4A:
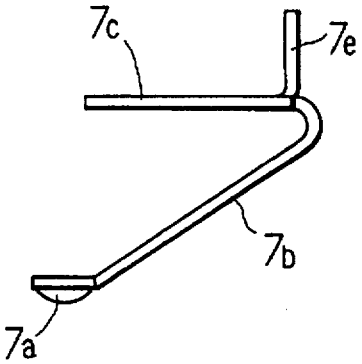
FIG. 4A is a side elevation view showing a slide element incorporated in the high-voltage variable resistor shown in FIG. 1A.
Figure 4B:
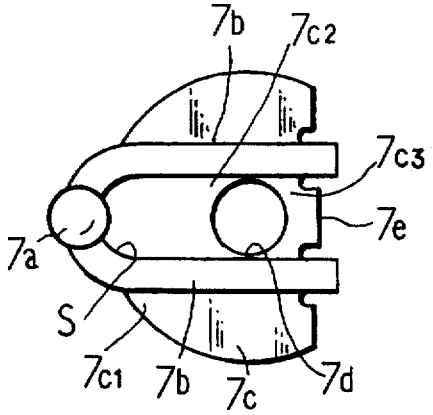
FIG. 4B is a bottom view of the slide element shown in FIG. 4A.
Figure 4C:
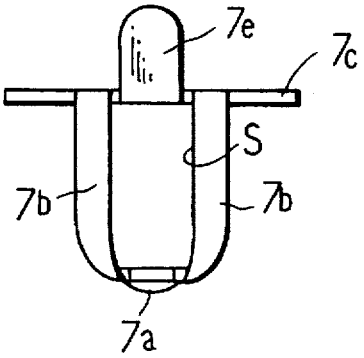
FIG. 4C is a front elevation view of the slide element shown in FIG. 4A.
Figure 5:
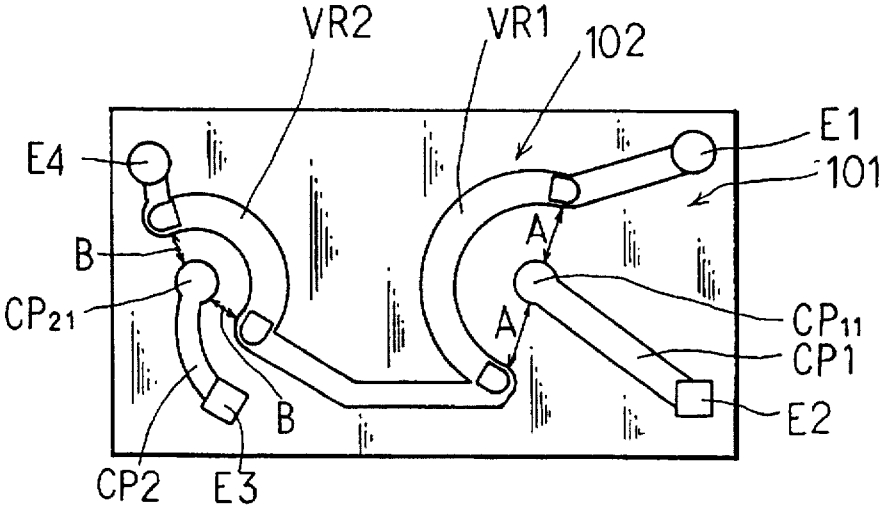
FIG. 5 is a plan view showing a circuit board incorporated in a conventional high-voltage variable resistor.

The slide element 7 may be made by subjecting a plate of metal such as stainless steel, phosphor bronze or the like to machining such as pressing, bending or the like and constructed as shown in FIGS. 4A to 4C. The slide element 7 includes an arm 7*b* provided with a slide contact 7*a* and a plate-like member 7*c* arranged so as to extend along an end surface of the slide element positioner 4*b*. The plate-like member 7*c* includes a slide portion 7*c*1 on which a contact 8*a* of a terminal fitment 8 slides, a through-hole portion 7*c*2 formed with a through-hole 7*d* through which the spacer 6 is inserted, and a mount portion 7*c*3 arranged opposite to the slide portion 7*c*1 with the through-hole 7*d* being interposed between the slide portion 7*c*1 and the mount portion 7*c*3. The mount portion 7*c*3 is provided with the raised element 7*e* fitted in the vertically extending hole 5 formed at the end of the operation shaft 4. The raised portion 7*e* is arranged so as to extend in a direction substantially perpendicular to the plate-like member 7*c* or toward the operation shaft 4. The arm 7*b* has a fixed end fixedly mounted on the mount portion 7*c*3 and a free end arranged so as to extend on a side of the slide portion 7*c*1. The arm 7*b* is formed with a slit S through which the spacer 6 is movably inserted. The mount portion 7*c*3 is engaged at edges thereof positioned on both sides of the arm 7*b* with the projections 4*d* for engagement. Insertion of the spacer 6 via the through-hole 7*d* of the plate-like member 7*c* and engagement of the edges of the mount portion 7*c*3 with the projections 4*d* ensures mounting of the slide element 7 on the operation shaft 4 while preventing release of the former from the latter. This permits the slide element 7 to be previously mounted on the operation shaft 4 for assembling of the high-voltage variable resistor, to thereby facilitate the assembling. Also, such construction effectively prevents shaking of the slide element 7 after the assembling. Engagement between the projections 4*d* and the edges of the mount portion 7*c*3 is carried out by intrusion of the edges into the projections 4*d*.

The terminal fitment 8 acts as a connection means and includes, as shown in FIG. 1A, an arm-like contact support 8*b* provided at one end thereof with the contact 8*a* contacted with the plate-like member 7*c* of the slide element 7 and a positioner 8*c* connected to the other end of the contact support 8*b*. The contact support 8*b* is bent at a portion thereof connected to the positioner 8*c* so as to be separated from the front surface of the circuit board 1 on a side of the one end thereof on which the contact 8*a* is mounted. The terminal fitment 8 is arranged so as to intersect a variable resistance pattern VR of an arcuate shape while being upwardly spaced from the variable resistance pattern. More particularly, the terminal fitment 8 is so arranged that the positioner 8*c* is positioned radially outwardly of the variable resistance pattern VR of an arcuate shape and the contact support 8*b* intersects the variable resistance pattern VR while being upwardly spaced from the variable resistance pattern VR. Referring to the circuit board 1' of FIGS. 2A and 2B by way of example, the contact support 8*b* of the terminal fitment 8 is arranged so as to extend from an edge of the circuit board as indicated at broken lines in FIG. 2A.

In the illustrated embodiment, the contact support 8*b* of the terminal fitment 8 and the arm 7*b* of the slide element 7 cooperate with each other to support the operation shaft 4. This results in a contact point between the contact 8*a* on the contact support 8*b* of the terminal fitment 8 and the plate-like member 7*c* of the slide element 7 being defined at a position separated by a predetermined distance from the front surface of the circuit board 1. In the illustrated embodiment, the contact 8*a* of the terminal fitment 8 is slid on a surface of the plate-like member 7*c* of the slide element 7 while describing a locus about an axis of the operation shaft 4.

The terminal fitment 8 and slide element 7 are so constructed or configured and dimensioned that a maximum potential difference between the terminal fitment 8 and slide element 7 and the variable resistance pattern VR is rendered smaller than a discharge occurrence potential difference. The illustrated embodiment has a possibility of causing the maximum potential difference to occur between the vicinity of a corner 7*c*4 of the plate-like member 7*c* of the slide element 7 shown in, for example, in FIG. 1B and a minimum potential portion of the variable resistance pattern VR.

The positioner 8*c* includes a plate-like element 8*d* fitted in a terminal fitment mounting hole 2*c* formed at an inner surface of the insulating casing 2 and a bent element 8*e* formed by bending a base of the contact support 8*b* into an L-shape. The bent element 8*e* is bent so as to interposedly support a part of a wall of the insulating casing 2 between the bent element 8*e* and the plate-like element 8*d* fitted in the mounting hole 2*c*. The positioner 8*c* of the terminal fitment 8 is integrally provided thereon with a terminal 8*f* in a manner to extend beyond a back surface of the circuit board in a direction opposite to the plate-like element 8*d*. Such integral arrangement of the terminal 8*f* on the positioner 8*c* of the terminal fitment 8 acting as the connection means decreases the number of parts required and facilitates assembling of the high-voltage variable resistor.

The illustrated embodiment is constructed so as to significantly reduce a space for arrangement of a variable resistance section on the circuit board including a space for arrangement of both the positioner 8*c* of the terminal fitment 8 and the variable resistance pattern VR thereon. More particularly, in FIG. 1A, reference character L designates a distance required to be provided between the positioner 8*c* of the terminal fitment 8 and a center of an arc of the variable resistance pattern VR and r is a radius of the arc. When the positioner 8*c* of the terminal fitment 8 is positioned inside the variable resistance pattern VR in a radial direction thereof, the largest length of a space for arrangement of the variable resistance section is equal to or above L+r, as shown in FIG. 1A. On the contrary, in the illustrated embodiment, the contact support 8*b* of the terminal fitment 8 is arranged so as to extend from an outside of the variable resistance pattern VR in the radial direction to an inside thereof, so that the radius r of the arc of the variable resistance pattern VR is contained in the dimension L. This permits the largest length of the arrangement space for the variable resistance section to be reduced to L at the lowest. Thus, it will-be noted that the present invention significantly reduces the space for arrangement of the variable resistance section on the circuit board, to thereby reduce a whole size of the circuit board.

The illustrated embodiment employs such an output extracting or withdrawing structure as shown in FIGS. 1A and 1B in order to minimize a size of the high-voltage variable resistor. FIG. 2A, as described above, shows the circuit board 1' of a rectangular shape, which has the input electrode E1', ground electrode E2', first and second variable resistance patterns VR1 and VR2 of an arcuate shape for double focus voltage variation, third variable resistance pattern VR3 of an arcuate shape for screen voltage variation and fixed resistance sections R1 to R3 formed on the front surface thereof. The circuit board 1' has a pair of oblique corner sides 1'*a* and 1'*b* formed by obliquely cutting a pair of corners defined in a longitudinal direction thereof, so that one of long sides of the circuit board, which is designated at reference character 1'*d*, is interposed between the oblique corner sides 1'*a* and 1'*b*. The other long side 1'*c* opposite to the one long side 1'*d* is formed at an intermediate portion thereof with a cutout 1'*e* of a suitable shape such as a circular shape, a triangular shape or the like.

Two or first and second terminal fitments 8 are provided in correspondence to the two variable resistance patterns VR1 and VR2 for focus voltage variation. The terminal fitments 8 are arranged so that positioners thereof are positioned on any two of plural sides defining the circuit board 1, respectively. In the illustrated embodiment, the terminal fitments 8 are arranged on the oblique corner side 1'*a* and long side 1'*c*. Also, a further or third terminal fitment 8 is provided in correspondence to the variable resistance pattern VR3 for screen voltage variation. The terminal fitment 8 likewise acting as a connection means is so arranged that a positioner is positioned on any one of the sides of the circuit board 1' other than the above-described two sides. In the illustrated embodiment, the third terminal fitment 8 is arranged on the oblique corner side 1'*b*. Such arrangement of the three terminal fitments 8 means that the terminal fitments are alternately positioned on the two long sides 1'*d* and 1'*c*. More specifically, it means that the terminal fitment 8 for an output of the first variable resistance pattern VR1 and the terminal fitment 8 for an output of the third variable resistance pattern VR3 which are arranged on both sides of the circuit board 1' defined in the longitudinal direction thereof are positioned on the one long side 1'*d* of the circuit board 1' and the terminal fitment 8 for the second variable resistance pattern VR2 which is arranged on a central portion of the circuit board 1' is positioned on the other long side 1'*c*. Such arrangement permits an insulation distance between output terminals of the terminal fitments to be increased even when the circuit board 1' is decreased in width.

The first and second variable resistance patterns VR1 and VR2 for double focus voltage variation are arranged so that openings of the two arcs of the variable resistance patterns VR1 and VR2 are opposite to each other or face inwardly of the circuit board. In other words, the first variable resistance pattern VR1 is formed so as to project toward the oblique corner side 1'*a* and the second variable pattern VR2 is formed so as to project toward the cutout 1'*e*. Also, the third resistance pattern VR3 is formed so as to project toward the oblique corner side 1'*b*. Thus, in the illustrated embodiment, the three variable resistance patterns VR1 to VR3 are arranged substantially in a row in the longitudinal direction of the circuit board 17. More specifically, the first to third variable resistance patterns VR1 to VR3 are arranged in such a manner that centers C1 to C3 the arcs respectively defined thereby are positioned on a virtual straight line CL defined on the circuit board so as to extend in the longitudinal direction thereof. This results in three operation shafts respectively provided with respect to the first to third resistance patterns VR1 to VR3 being linearly aligned with each other. Further, in the illustrated embodiment, the variable resistance patterns VR1 to VR3 are arranged so as to form a closed loop. Of course, the illustrated embodiment may be so constructed that the first and second variable resistance patterns VR1 and VR2 are connected in parallel to each other to form a parallel circuit and the third variable resistance pattern VR3 is connected in series to the parallel circuit.

The insulating casing 2' received in the circuit board 1' is constructed as shown in FIG. 2B. The insulating casing 2' is formed on an inner surface thereof with a rib 2'*a* on which the circuit board 1 is carried. The rib 2'*a* includes rib portions 2'*a*1 to 2'*a*3 arranged so as to positionally correspond to the oblique corner sides 1'*a* and 1'*b* of the circuit substrate 1' and the cutout 1'*e*. The rib portions 2'*a*1 to 2'*a*3 are formed with terminal fitment mounting holes 2'*c*1 to 2'*c*3 in which plate-like elements of the terminal fitments 8 constructed like the terminal fitment 8 shown in FIG. 1A and each acting as a connection means are fitted. When the terminal fitments are fitted in the mounting holes 2'*c*1 to 2'*c*3, respectively, the contact supports 8*b* of the terminal fitments 8 each intersect the corresponding variable resistance pattern from an outside of the arc of the variable resistance pattern while being kept upwardly spaced from the pattern. Thus, the terminal fitments each are so arranged that the positioner is positioned outside the corresponding variable resistance pattern of an arcuate shape in the radial direction thereof and the contact support intersects the variable resistance pattern while being upwardly spaced therefrom. Also, the three operation shafts are arranged in such a manner that angles θ1 to θ3 between the virtual straight line CL on which centers of shaft members of the operation shafts are arranged and directions in which the contact supports of the terminal fitments extend each are smaller than 90 degrees. The angles θ1 to θ3 each may be defined to be "an angle between a central line of the contact support extending in a longitudinal direction thereof as the contact support is viewed from right above and the virtual straight line" or "an angle θ between a shade obtained when the contact support of the terminal fitment is projected on the circuit board and the virtual straight line". In the illustrated embodiment, the angles θ1 to θ3 each may be set to be about 45 degrees. Setting of each of the angles at 45 degrees or less permits a width of the circuit board 1' to be further reduced.

Thus, the high-voltage variable resistor of the illustrated embodiment includes the output extracting structure constructed as shown in FIGS. 1A and 1B and is so constructed that the angles θ1 to θ3 are set to be less than 90 degrees. Thus, the illustrated embodiment substantially reduces a width of the circuit board 1.

Now, manufacturing of the high-voltage variable resistor of the illustrated embodiment constructed as described above will be described hereinafter with reference to FIGS. 1A and 1B. First, the insulating casing 2 is carried on a jig while keeping the opening of the casing 2 upwardly facing. Then, the operation shafts 4 each having the slide element 7 previously mounted on an end thereof each are arranged on a predetermined place of the insulating casing 2. Then, the plate-like element 8*d* of each of the terminal fitments 8 is fitted in the mounting hole 2*c* and the rib 2*a* of the insulating casing 2 is interposedly supported at a part thereof between the plate-like element 8*d* and the bent element 8*e*, so that the terminal fitment 8 is mounted on the insulating casing. Concurrently, the contact 8*a* of the contact support 8*b* is contacted with the plate-like member 7*c* of the slide element 7. Subsequently, the circuit board 1 is joined onto the rib 2*a* of the insulating casing 2 by means of an adhesive. Further, in the illustrated embodiment, an insulating resin material is filled on a side of the back surface of the circuit board and then cured, resulting in an insulating resin layer being provided. The high-voltage variable resistor thus manufactured is typically mounted on a casing of a flyback transformer, although it may be used as it is.

When it is desired to apply oil such as grease or the like to an outer periphery of the shaft member 4*a* of the operation shaft 4, adhesion of the oil to the slide element may possibly occur. Such adhesion may be effectively prevented by first mounting the shaft member of the operation shaft 4 on the insulating casing 2 and then mounting the slide element 7 on the operation shaft.

When a plurality of variable resistance patterns are formed on the circuit board, the structure shown in FIGS. 1A and 1B may be applied to each of the patterns. Alternatively, the structure of FIGS. 1A and 1B may be applied to at least one of the variable resistance patterns and the remaining variable resistance patterns may use a conventional output extracting structure or that disclosed in U.S. patent application Ser. No. 08/579,104. The output extracting structure disclosed in the U.S. patent application is so constructed that a positioner of each of connection means is arranged inside a variable resistance pattern in a radial direction thereof and a contact point between a contact of the connection means and a slide element is likewise arranged inside the variable resistance pattern.

In the illustrated embodiment, each of the terminal fitments 8 acting as the connection means is made of metal and the slide element is likewise made of metal. Alternatively, the contact of each of the terminal fitments may be coated with a conductive resin paint or the contact of at least one of the connection means and slide element may be made of a conductive plastic or rubber material. Use of a conductive plastic material for formation of the connection means provided with a connection conductor holder permits injection molding to be used therefor, resulting in saving of the material.

In the illustrated embodiment, the connection means is integrally provided with the output terminal. Alternatively, the connection means and output terminal may be separated from each other. In this instance, the high-voltage variable resistor may be of course constructed so that an output electrode is formed on the circuit board and connected to the positioner of the terminal fitment by soldering, resulting in the connection means being connected directly to the circuit board. Also, a conductive rubber material may be arranged between the circuit board and the insulating casing and the positioner of the terminal fitment or connection means may be inserted at a plug-in portion thereof into the rubber material to position the connection means. In this instance, the output terminal may be inserted via a through-hole of the circuit board into the conductive rubber.

In addition, in the illustrated embodiment, the insulating resin layer is formed on a side of the back surface of the circuit board as described above. Alternatively, the opening of the receiving chamber 3 of the insulating casing 2 may be closed with a cover member.

As can be seen from the foregoing, the present invention permits the space for arrangement of the variable resistance section on the circuit board to be significantly reduced, resulting in the circuit board being decreased in size, so that the high-voltage variable resistor may be downsized.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor comprising:

a circuit board provided on a front surface thereof with at least one variable resistance pattern and an insulating casing in which said circuit board is received;

at least one operation shaft arranged so as to be spaced from said front surface of said circuit board;

at least one slide element mounted on said operation shaft and including a slide contact sliding on said variable resistance pattern; and at least one connection means including an output section and contacted with a part of said slide element to electrically connect said slide element and output section to each other;

said connection means and slide element being so arranged that a contact point between said connection means and said slide element is spaced from said front surface of said circuit board on a slide of said operation shaft;

said connection means including a contact contacted with said slide element, a contact support for supporting said contact thereon and a positioner for positioning said contact support with respect to at least one of said circuit board and insulating casing;

said connection means being arranged so that said contact support intersects said variable resistance pattern while being spaced from said variable resistance pattern.

2. A high-voltage variable resistor comprising:

a circuit board provided on a front surface thereof with at least one variable resistance pattern of an arcuate shape and an insulating casing in which said circuit board is received;

at least one operation shaft arranged so as to be spaced from said front surface of said circuit board;

at least one slide element fixed on said operation shaft and including a slide contact sliding on said variable resistance pattern; and at least one connection means including an output section and contacted with a part of said slide element to electrically connect said slide element and output section to each other;

said connection means and slide element being so arranged that a contact point between said connection means and said slide element is spaced from said front surface of said circuit board on a side of said operation shaft and a maximum potential difference between said connection means and slide element and said variable resistance pattern is rendered lower than a discharge occurrence potential difference;

said connection means including a contact contacted with said slide element, a contact support for supporting said contact thereon and a positioner for positioning said contact support with respect to at least one of said circuit board and insulating casing;

said connection means being arranged so that said positioner is positioned outside said variable resistance pattern in a radial direction thereof and said contact support intersects said variable resistance pattern while being spaced from said variable resistance pattern.

3. A high-voltage variable resistor as defined in claim 2, wherein said slide element includes an arm provided with a slide contact slid on a surface of said variable resistance pattern and a plate-like member supported on an end of said operation shaft opposite to said circuit board;

said end of said operation shaft being provided with a spacer which is arranged so as to be coaxial with said operation shaft and project therefrom toward said circuit board; and said connection means is arranged so that said contact slides on a surface of said plate-like member of said slide element while describing a locus about an axis of said operation shaft.

4. A high-voltage variable resistor as defined in claim 3, wherein said plate-like member of said slide element includes a slide portion on which said contact of said connection means slides, a through-hole portion formed with a through-hole via which said spacer is inserted and a mount portion opposite to said slide portion with said through-hole being interposed between said mount portion and said slide portion;

said arm has a fixed end fixed on said mount portion and a free end extending toward said slide portion; and said arm is formed with a slit through which said spacer is movably inserted.

5. A high-voltage variable resistor as defined in claim 3, wherein said mount portion of said slide element is provided with a raised portion so as to extend toward said operation shaft;

said end of said operation shaft is formed with a hole in which said raised portion is fitted; and said end of said operation shaft is integrally formed with a projection with which said plate-like member is engaged.

6. A high-voltage variable resistor comprising:

a circuit board provided on a front surface thereof with a plurality of variable resistance patterns of an arcuate shape and an insulating casing in which said circuit board is received;

a plurality of operation shafts arranged so as to be spaced from said front surface of said circuit board and respectively correspond to said variable resistance patterns;

a plurality of slide elements respectively mounted on said operation shafts and each including a slide contact sliding on the variable resistance pattern corresponding thereto; and a plurality of connection means arranged so as to respectively correspond to said variable resistance patterns and each including an output section and contacted with a part of each of said slide elements to electrically connect said slide element and output section to each other;

said variable resistance patterns being arranged on said front surface of said circuit board so that centers of arcs respectively defined by said variable resistance patterns of an arcuate shape are aligned with each other in a longitudinal direction of said circuit board;

said connection means and slide elements each being so arranged that a contact point between said connection means and said slide element is spaced from said front surface of said circuit board on a side of said operation shaft;

said connection means each being arranged so that said positioner is positioned outside said variable resistance pattern in a radial direction thereof and said contact support intersects said variable resistance pattern while being spaced from said variable resistance pattern.

7. A high-voltage variable resistor as defined in claim 6, wherein said variable resistance patterns are formed on said front surface of said circuit board so that centers of arcs respectively defined by said variable resistance patterns of an arcuate shape are aligned with each other on a virtual straight line extending in said longitudinal direction of said circuit board.

8. A high-voltage variable resistor as defined in claim 7, wherein said connection means each are so arranged that an angle between said virtual straight line and a shade of said contact support of said connection means obtained when said connection support is projected on said circuit board is less than 90 degrees.

9. A high-voltage variable resistor as defined in claim 8, wherein said angle is 45 degrees or less.

10. A high-voltage variable resistor as defined in claim 6, wherein said connection means are so arranged that said positioners of two said connection means provided in correspondence to two said variable resistance patterns adjacent to each other are arranged on different two of sides of said circuit board.

11. A high-voltage variable resistor comprising:

a circuit board provided on a front surface thereof with two variable resistance patterns of an arcuate shape for focus voltage variation and one variable resistance pattern of an arcuate shape for screen voltage variation and an insulating casing in which said circuit board is received;

three operation shafts arranged so as to be spaced from said front surface of said circuit board;

three slide elements respectively mounted on said operation shafts and each including a slide contact sliding on the variable resistance pattern corresponding thereto; and three connection means each including an output section and contacted with a part of the slide element corresponding thereto to electrically connect said slide element and output section to each other;

said three variable resistance patterns being arranged on said front surface of said circuit board so that centers of arcs respectively defined by said variable resistance patterns of an arcuate shape are aligned with each other in a longitudinal direction of said circuit board;

said two variable resistance patterns for focus voltage variation being arranged on said front surface of said circuit board so that openings of said two variable resistance patterns of an arcuate shape are rendered opposite to each other while being kept facing inwardly;

said connection means and slide elements each being so arranged that a contact point between said connection means and said slide element is spaced from said front surface of said circuit board on a side of said operation shaft;

said three connection means each including a contact contacted with said slide element, a contact support for supporting said contact thereon and a positioner for positioning said contact support with respect to at least one of said circuit board and insulating casing;

said three connection means each being arranged so that said positioner is positioned outside said variable resistance pattern in a radial direction thereof and said contact support intersects said variable resistance pattern while being spaced from said variable resistance pattern.

12. A high-voltage variable resistor as defined in claim 11, wherein said three variable resistance patterns are connected to each other so as to form a closed loop.

13. A high-voltage variable resistor as defined in claim 11, wherein at least two of said variable resistance patterns are arranged on said front surface of said circuit board so that centers of arcs respectively defined by said at least two variable resistance patterns are aligned with each other along a virtual straight line defined in a longitudinal direction of said circuit board; and said connection means each are so arranged that an angle between said virtual straight line and a central line extending in a longitudinal direction of said contact support of said connection which is defined as said contact support is viewed from right above said circuit board is less than 90 degrees.

14. A high-voltage variable resistor as defined in claim 13, wherein said angle is 45 degrees or less.

15. A high-voltage variable resistor as defined in claim 11, wherein two said connection means provided in correspondence to said two variable resistance patterns for focus voltage variation are so arranged that said positioners of said two connection means are positioned on two different first and second ones of sides of said circuit board; and one said connection means provided in correspondence to said variable resistance pattern for screen voltage variation is so arranged that said positioner of said one connection means is positioned on third one of said sides of said circuit board which is different from said first and second sides.

16. A high-voltage variable resistor comprising:

a circuit board provided on a front surface thereof with a plurality of variable resistance patterns of an arcuate shape and an insulating casing in which said circuit board is received;

a plurality of operation shafts arranged so as to be spaced from said front surface of said circuit board and respectively correspond to said variable resistance patterns;

a plurality of slide elements respectively mounted on said operation shaft and each including a slide contact sliding on the variable resistance pattern corresponding thereto; and a plurality of connection means arranged so as to respectively correspond to said variable resistance patterns and each including an output section and contacted with a part of each of said slide elements to electrically connect said slide element and output section to each other;

at least one pair of said variable resistance patterns being arranged on said front surface of said circuit board so that openings respectively defined by said variable resistance patterns of an arcuate shape are rendered opposite to each other while being kept facing inwardly;

said connection means and slide elements each being so arranged that a contact point between said connection means and said slide element is spaced from said front surface of said circuit board on a side of said operation shaft;

said connection means each including a contact contacted with said slide element, a contact support for supporting said contact thereon and a positioner for positioning said contact support with respect to at least one of said circuit board and insulating casing;

said connection means each being arranged so that said positioner is positioned outside said variable resistance pattern in a radial direction thereof and said contact support intersects said variable resistance pattern while being spaced from said variable resistance pattern.

17. A high-voltage variable resistor comprising:

a circuit board provided on a front surface thereof with two variable resistance patterns of an arcuate shape and an insulating casing in which said circuit board is received;

two operation shafts arranged so as to be spaced from said front surface of said circuit board and respectively correspond to said variable resistance patterns;

two slide elements respectively mounted on said operation shafts and each including a slide contact sliding on the variable resistance pattern corresponding thereto; and two connection means arranged so as to respectively correspond to said variable resistance patterns;

said connection means each including an output section and being contacted with a part of the slide element corresponding thereto to electrically connect said slide element and output section to each other;

said two variable resistance patterns being arranged on said front surface of said circuit board so that openings respectively defined by said variable resistance patterns of an arcuate shape are rendered opposite to each other while being kept facing inwardly;

said connection means and slide elements each being so arranged that a contact point between said connection means and said slide element is spaced from said front surface of said circuit board on a side of said operation shaft;

said connection means each including a contact contacted with said slide element, a contact support for supporting said contact thereon and a positioner for positioning said contact support with respect to at least one of said circuit board and insulating casing;

said three connection means each being arranged so that said positioner is positioned outside said variable resistance pattern in a radial direction thereof and said contact support intersects said variable resistance pattern while being spaced from said variable resistance pattern.

* * * * *